US005935347A

United States Patent [19]

Suzuki et al.

[11] Patent Number: 5,935,347

[45] Date of Patent: Aug. 10, 1999

[54] FE-BASE SOFT MAGNETIC ALLOY AND LAMINATED MAGNETIC CORE BY USING THE SAME

[75] Inventors: Kiyonori Suzuki; Akihiro Makino, both of Nagaoka; Shoji Yoshida, Nakanoshima-machi; Katsuaki Hangai, Nagaoka; Tsuyoshi Masumoto; Akihisa Inoue, both of Sendai, all of Japan

[73] Assignee: Alps Electric Co., Ltd.

[21] Appl. No.: 08/770,369

[22] Filed: Nov. 29, 1996

Related U.S. Application Data

[63] Continuation of application No. 08/364,643, Dec. 27, 1994, abandoned.

[30] Foreign Application Priority Data

Dec. 28, 1993 [JP] Japan ..... 5-338335
Mar. 28, 1994 [JP] Japan ..... 6-057889

[51] Int. Cl.[6] ..... H01F 1/147

[52] U.S. Cl. ..... 148/121; 29/605

[58] Field of Search ..... 148/121; 29/605

[56] References Cited

U.S. PATENT DOCUMENTS

| | | | |
|---|---|---|---|
| 4,623,387 | 11/1986 | Masumoto et al. | 420/41 |
| 4,834,816 | 5/1989 | Hasegawa et al. | 148/304 |
| 4,842,657 | 6/1989 | Masumoto et al. | 148/403 |
| 4,918,555 | 4/1990 | Yoshizawa et al. | 360/125 |
| 5,086,554 | 2/1992 | Murata et al. | 29/605 |
| 5,160,379 | 11/1992 | Yoshizawa et al. | 148/108 |
| 5,340,413 | 8/1994 | Martis | 148/305 |
| 5,474,624 | 12/1995 | Suzuki et al. | 148/121 |
| 5,524,334 | 6/1996 | Boesel | 29/605 |
| 5,639,566 | 6/1997 | Okamura et al. | 428/692 |

FOREIGN PATENT DOCUMENTS 1-242757 9/1989 Japan .

OTHER PUBLICATIONS

Materials Transaction, *JIM, vol. 31, No. 4 (1990), pp. 307–314 by Y. Yoshizawa and K. Yamauchi*, and "Conference on Metallic Glasses: Science and Technology Budapest", 1980 by C. Hargitai, I. Bakonyi and T. Kemeny.

*Primary Examiner*—John Sheehan
*Attorney, Agent, or Firm*—Brinks Hofer Gilson & Lione

[57] ABSTRACT

The present invention provides an Fe-base soft magnetic alloy and a laminated magnetic core formed by using the alloy which contains Fe as a main component and at least one element M and B selected from the group consisting of Ti, Zr, Hf, V, Nb, Ta, Mo and W, in which at least 50% of the crystalline structure comprises fine crystalline grains having an average crystal grain size of 30 nm or less and a body-centered cubic structure, and the fracture strain at 300° C. or less is 1. The ratios of the components Fe, and elements M and B are 75 to 93 atomic %, 4 to 9 atomic % and 0.5 to 18 atomic %, respectively. The alloy may contain other additive elements such as Cr, Ru, Hr, Ir, Si, Al, Ge, Ga and the like.

24 Claims, 8 Drawing Sheets

FE-BASE SOFT MAGNETIC ALLOY AND LAMINATED MAGNETIC CORE BY USING THE SAME

This application is a continuation of application Ser. No. 08/364,643, filed Dec. 27, 1994 now abandoned.

BACKGROUND OF THE INVENTION

The present invention relates to a soft magnetic alloy and a laminated magnetic core formed by using the same which is used for a transformer, a choke coil, a magnetic head, etc, and in particular to a soft magnetic alloy and a laminated magnetic core having a high heat resistance, a high saturation magnetic flux density and excellent soft magnetic characteristics.

A soft magnetic alloy for use in a magnetic head, a transformer, a choke coil or the like must have the following characteristics:

(1) high magnetic flux density;

(2) high magnetic permeability;

(3) small coercive force:

(4) low magnetostriction; and (5) a thin shape which can easily be formed.

The magnetic head must have the following characteristics in order to improve the wear resistance in addition to the foregoing characteristics (1) to (5):

(6) excellent hardness.

Therefore, materials for a variety of alloy systems have been studied to satisfy the foregoing characteristics when a soft magnetic alloy or a magnetic head is manufactured. Hitherto, crystalline alloys such as sendust, permalloy and iron-silicon steel and the like have been employed for use in the foregoing purposes. Recently, an Fe-base or Co-base amorphous alloy has been used.

Under the foregoing circumstances, the magnetic head must be adaptable to a magnetic recording medium of a type having large coercive force required to record information at a high density by employing further suitable magnetic material to form the magnetic head that exhibits excellent performance. Further the size of the transformer and the choke coil must be further reduced to be adaptable to the trend of reducing electronic equipment by using a magnetic material having further satisfactory performance.

However, sendust suffers from unsatisfactorily low saturation magnetic flux density of about 11 KG although it has excellent soft magnetic characteristics. Also permalloy encounters a problem of an unsatisfactorily low saturation magnetic flux density of about 8 KG when it is formed into an alloy structure that exhibits excellent soft magnetic characteristics. The iron-silicon steel (Fe—Si Alloy) has a problem of unsatisfactory soft magnetic characteristics although it exhibits a high saturation magnetic flux density.

As for the amorphous alloy, the Co-base alloy has an unsatisfactory saturation magnetic flux density of about 10 KG although it has excellent soft magnetic characteristics. Although the Fe-base alloy exhibits a high saturation magnetic flux density of 15 KG or higher, the attained soft magnetic characteristics are unsatisfactory. The stability of the amorphous alloy against heat is insufficient, resulting in a problem to be solved. Therefore, it is difficult to simultaneously realize the high saturation magnetic flux density and excellent soft magnetic characteristics.

An alloy for a transformer having a high saturation magnetic flux density and exhibiting a low core loss has been disclosed in U.S. Pat. No. 5,069,731, the composition of which is expressed by the following general formula:

$$(Fe_{1-a}M_{1a})_{100-x-y-z-t}CU_xSi_yB_zM_{2t}$$

wherein $M_1$ is Co and/or Ni, $M_2$ is at least one element selected from a group consisting of Nb, W, Ta, Mo, Zr, Hr and Ti, a, x, y, z and t respectively satisfy, by atom %, $0 \leqq a \leqq 0.3$, $0.1 \leqq x \leqq 3$, $0 \leqq y \leqq 17$, $4 \leqq z \leqq 17$, $10 \leqq y+z \leqq 28$ and $0.1 \leqq t \leqq 5$.

At least 50% of the structure is made of fine crystalline grains and the average grain size obtained by measuring the maximum crystalline grain is 1000 Å or less.

The foregoing fine crystalline alloy has been developed while making a Fe—Si—B amorphous alloy, disclosed in U.S. Pat. No. 5,160,379, as a starting material. In the Fe—Si—B alloy, elements for making the structure to be amorphous are Si and B and the content of Fe in an alloy having sufficient heat stability in terms of practical use is 70 to 80 atom %. The foregoing amorphous alloy has magnetic characteristics superior to that of the conventional Fe—Si alloy (iron-silicon alloy). The fine crystalline alloy disclosed above is a Fe—$M_1$—Cu—Si—B—$M_3$ alloy made by adding Cu and M elements to a Fe—Si—B alloy, where the elements $M_3$ is at least one element selected from a group consisting of Nb, W, Ta, Zr, Hf, Ti and Mo.

It is necessary for the alloy of the foregoing type to contain Cu because it has been said that the addition of Cu causes fluctuation to occur in the amorphous to generate fine crystalline grains and, accordingly, the structure can be made fine. It has been disclosed in the foregoing application that the omission of the addition of Cu cannot easily produce fine crystalline grains, a compound phase can easily be generated and therefore the magnetic characteristics deteriorate.

In the alloy of the foregoing system, the mutual action between Cu and Nb is able to prevent the enlargement of the crystalline grains. Therefore, it has been considered that composite addition of Nb and Cu is required because sole addition of Nb or Cu cannot prevent the enlargement of the crystalline grains. The foregoing fact has been disclosed by the inventors of the foregoing disclosure in Journal of Materials Transaction, JIM, Vol. 31, No. 4 (1990), pp. 307–314.

FIG. 20 of U.S. Pat. No. 5,160,370, which is a composition diagram, illustrates an important fact that the low magnetostriction cannot be obtained from the alloy of the foregoing system if Si=0. Since Si acts to reduce the magnetostriction, Si must be added to reduce the magnetostriction.

The inventors of the present invention have been developing soft magnetic material by using material of a component system which is completely different from an extremely different viewpoint. Among others, there is a Fe(Co, Ni)—Zr alloy system previously disclosed in U.S. Pat. Nos. 4,623,387 and 4,842,657 established while considering the conventional technologies about sendust, permalloy and iron-silicon steel.

The Fe(Co, Ni)—Zr alloy system contains Zr having excellent performance of forming amorphous added thereto and, accordingly, amorphous alloy can be formed even if the amount of Zr added is reduced. Therefore, the concentration of Fe can be made about 90% or higher. Further, Hf can be used-as an element for forming an amorphous alloy similar to Zr. However, the Curie temperature of the alloy of a type containing Fe at a high concentration is in the vicinity of the room temperature and, therefore, the alloy of the foregoing type is not a practical alloy as the material for the magnetic core.

The inventors of the present invention have found the fact that partial crystallization of Fe—Hf amorphous alloy by a special method enables a fine crystalline structure having an average crystalline grain size of about 10 to 20 nm, and disclosed this in "CONFERENCE ON METALLIC SCIENCE AND TECHNOLOGY BUDAPEST", 1980, pp. 217 to 221. It can be considered from the disclosed technology that fining of the structure of the Fe—M alloy can be enabled even if elements such as Cu are not added. Although the mechanism of this has not been clarified yet, fluctuation of the structure is already present in a rapidly solidified state in a case where the amorphous phase is formed and the fluctuation becomes nucleation site resulting in that a multiplicity of uniform and fine nuclei are generated.

As a result of repeated research on the alloys of the foregoing type, the inventors of the present invention also found that excellent characteristics which cannot be obtained by the Fe—$Ma_1$—Cu—Si—B—$M_3$ alloy disclosed in the foregoing Japanese Paten Publication No. 4-4393 (U.S. Pat. No. 5,160,379) are obtained. Namely, since the Fe—$M_1$—Cu—Si—B—$M_3$ alloy has the property of being abruptly made brittle by heat treatment at 150 to 200° C., the alloy has the drawback that it cannot be applied to a product completed by a process including heat treatment, or including the step of machining without heat treatment and partial heating within the above temperature range, e.g., a transformer produced by cutting an alloy ribbon in appropriate width and length, coiling the cut ribbon and then heat-treating the coil formed, a junction type magnetic head produced through a glass welding step, or a laminate type magnetic head produced by punching an alloy ribbon and then laminating the rings obtained. Further, where a laminated core is manufactured by laser beam machining, there is the problem that the alloy cannot be applied for manufacturing the laminated core by laser beam machining because the alloy is made brittle at a low temperature of 150 to 200° C. The alloy also has the problem that it is unsuitable for warm press working at the above temperature or more.

Although a 50% Ni—Fe permalloy magnetic core or a 80% Ni—Fe permalloy magnetic core is conventionally used as a magnetic core material for the transformer or choke coil, a magnetic core comprising such a magnetic material exhibits a high core loss within a high frequency range, and an abrupt temperature rise within a frequency band of several tens kHz or more, thereby causing difficulty of using the magnetic core.

Therefore, a magnetic core comprising a Co-base amorphous magnetic material has recently been used as a switching power source magnetic core by making use of the characteristics thereof with respect to a low core loss within a high frequency region and high squareness forming properties. However, the Co-base amorphous magnetic core has the problems that it is high cost because of the high material cost, the saturation magnetic flux density is generally 10 kG or less, and the core is susceptible to limit of the operating magnetic flux density within the frequency region of several tens kHz to 100 kHz because of the low saturation magnetic flux density, thereby inhibiting sufficient miniaturization of the magnetic core.

On the other hand, it has been known that a magnetic core comprising an Fe-base amorphous magnetic material exhibits a high saturation magnetic' flux density, a direct current B—H curve having a high squareness ratio and maximum permeability, as disclosed in, for-example, Japanese Patent Publication No. 58-1183.

However, the magnetic core formed by using the Fe-base amorphous alloy has a drawback of high core loss. Although, an attempt is thus made to decrease the core loss by adjusting the elements added, the magnetic core still has the problem of higher core loss than that of the Co-base amorphous alloy.

A first object of the present invention is to provide an excellent Fe-base soft magnetic alloy which has a high saturation magnetic flux density, permeability, mechanical strength and thermal stability, which can resist heat in glass welding, laser beam machining or machining such as cutting or press working, and which can exhibit excellent soft magnetic characteristics after working.

A second object of the present invention is to provide a laminated magnetic core exhibiting a low core loss within a high frequency region and a high saturation magnetic flux density.

SUMMARY OF THE INVENTION

In order to achieve the objects, the present invention provides an Fe-base soft magnetic alloy containing Fe as a main component, and at least one element M selected from the group consisting of Ti, Zr, Hf, V, Nb, Ta, Mo and W, wherein at least 50% of crystalline structure comprises fine crystalline grains having an average crystalline grain size of 30 nm or less and a body-centered cubic structure, and the relative strain for fracture (fracture strain) at 300° C. or less is 1.

A laminated magnetic core according to the present invention is formed by toroidally winding a ribbon of the Fe-base soft magnetic alloy having an insulated surface, or laminating, through insulating layers, a plurality of rings punched out from the ribbon, coating the surface of the core with an insulating substance and then performing winding thereon.

A first composition of the Fe-base soft magnetic alloy is represented by the following formula:

$$Fe_bB_xM_y$$

wherein M is at least one element selected from the group consisting of Ti, Zr, Hf, V, Nb, Ta, Mo and W, any one of Zr, Hf and Nb is contained, and composition ratios b, x and y satisfy the relations b=75 to 93 atomic %, x=0.5 to 12 atomic %, and y=4 to 9 atomic %, respectively.

A second composition of the alloy is represented by the following formula:

$$(Fe_{1-a}Z_a)_bB_xM_y$$

wherein Z is at least one of Co and Ni, M is at least one element selected from the group consisting of Ti, Zr, Hf, V, Nb, Ta, Mo and W, any one of Zr, Hf and Nb is contained, and composition ratios a, b, x and y satisfy the relations a ≦0.2, b=75 to 93 atomic %, x=0.5 to 12 atomic %, and y=4 to 9 atomic %, respectively.

The Fe-base soft magnetic alloys having the compositions according to the present invention exhibit a value of fracture strain which does not decrease within the temperature region of 300 to 500°, according to the compositions. This means that even when the alloy of the present invention is partially heated to a temperature of 300 to 500° C. in working, the alloy itself is not made brittle. Since the alloy of the present invention is not made brittle by entirely or partially heat-treating the alloy in machining such as press machining, laser machining or cutting, the alloy of the present invention can be applied to a troidal core, a transformer or a laminated magnetic head which must be formed by the above machining.

Since the laminated magnetic core of the present invention is formed by laminating rings obtained from a soft magnetic alloy ribbon having the specified composition, the core is characterized by a high saturation magnetic flux density and a small core loss. Particularly, the core according to the present invention exhibits an excellent saturation magnetic flux density which is equivalent to that of a magnetic core comprising a Fe—Si—B system amorphous alloy which is known as having excellent soft magnetic characteristics, and a lower core loss than the Fe—Si—B system amorphous alloy. The present invention can thus provide a small and lightweight magnetic core having a low loss within a high frequency region and a high saturation magnetic flux density.

DETAILED DESCRIPTION OF THE INVENTION

Figure 1A:
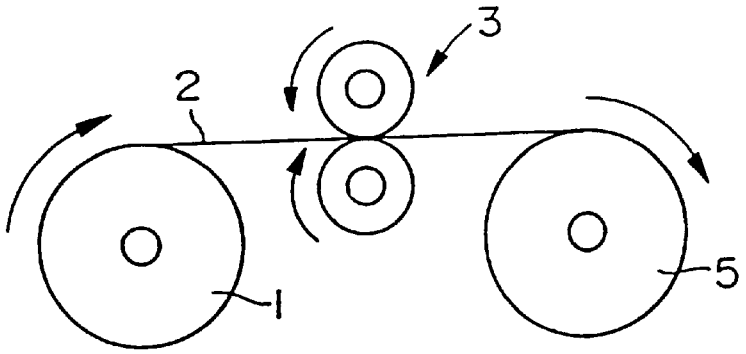
FIG. 1(*a*) is a perspective view showing the state where an alloy ribbon according to the present invention is cut by a cutting device, and FIG. 1(*b*) is a plan view showing the cut ribbon.

A first example of the alloys of the present invention has a composition represented by the following formula:

$$Fe_bB_xM_y$$

wherein M is at least one element selected from the group consisting of Ti, Zr, Hf, V, Nb, Ta, Mo and W, any one of Zr, Hf and Nb is contained, and composition ratios b, x and y satisfy the relations b=75 to 93 atomic %, x=0.5 to 18 atomic %, and y=4 to 9 atomic %, respectively.

A second example of the alloys of the present invention has a composition represented by the following formula:

$$(Fe_{1-a}Z_a)_bB_xM_y$$

wherein Z is at least one of Co and Ni, M is at least one element selected from the group consisting of Ti, Zr, Hf, V, Nb, Ta, Mo and W, any one of Zr, Hf and Nb is contained, and composition ratios a, b, x and y satisfy the relations a ≦0.2, b=75 to 93 atomic %, x=0.5 to 18 atomic %, and y=4 to 9 atomic %, respectively.

A third example of the alloys of the present invention has a composition represented by the following formula:

$$Fe_bB_xM_yX_z$$

wherein X is one or two of Cr, Ru, Rh and Ir, and composition ratios b, x, y and z satisfy the relations b=75 to 93 atomic %, x=0.5 to 18 atomic %, y=4 to 9 atomic %, and z≦5 atomic %, respectively.

A fourth example of the alloys of the present invention has a composition represented by the following formula:

$$(Fe_{1-a}Z_a)_bB_xM_yX_z$$

wherein composition ratios a, b, x, y and z satisfy the relations a ≦0.1, b=75 to 93 atomic %, x=0.5 to 18 atomic %, y=4 to 9 atomic %, and z≦5 atomic %, respectively.

A fifth example of the alloys of the present invention has a composition represented by the following formula:

$$Fe_bB_xM_yX'_t$$

wherein X' is at least one of Si, Al, Ge and Ga, and composition ratios b, x, y and t satisfy the relations b=75 to 93 atomic %, x=0.5 to 18 atomic %, y=4 to 9 atomic %, and t≦4 atomic %, respectively.

A sixth example of the alloys of the present invention has a composition represented by the following formula:

$$(Fe_{1-a}Z_a)_bB_xM_yX'_t$$

wherein composition ratios a, b, x, y and t satisfy the relations a ≦0.2, b=75 to 93 atomic %, x=0.5 to 18 atomic %, y=4 to 9 atomic %, and t≦4 atomic %, respectively.

A seventh example of the alloys of the present invention has a composition represented by the following formula:

$$Fe_bB_xM_yX_zX'_t$$

wherein composition ratios b, x, y, z and t satisfy the relations b=75 to 93 atomic %, x=0.5 to 18 atomic %, y =4 to 9 atomic %, z≦5 atomic %, and t≦4 atomic %, respectively.

An eighth example of the alloys of the present invention has a composition represented by the following formula:

$$(Fe_{1-a}Z_a)_bB_xM_yX_zX'_t$$

wherein composition ratios a, b, x, y, z and t satisfy the relations a ≦0.2, b=75 to 93 atomic %, x=0.5 to 18 atomic a%, y=4 to 9 atomic %, z≦5 atomic %, and t≦4 atomic %, respectively.

The reasons why the soft magnetic alloys having the aforegoing compositions are preferred are described below.

Each of the alloys having the compositions invariably contains B. Since B is considered as having the effects of increasing the ability to form an amorphous substance in a soft magnetic alloy, and of preventing the production of a compound phase which adversely affects the magnetic characteristics in the heat treatment step, the addition of B is essential.

Although Zr and Hf are hardly dissolved in α—Fe, the entire alloy having one of the compositions is quenched to make it amorphous so that Zr and Hf can be dissolved to supersaturation. The amount of the elements dissolved is then adjusted by heat treatment to partialy crystallize and precipitate the elements as a fine crystalline phase. This can improve the soft magnetic characteristics of the resultant soft magnetic alloy, and decrease the magnetostriction of a ribbon of this alloy. It is thought to be necessary for precipitating the fine crystalline phase and preventing an increase in the grain size thereof to leave an amorphous phase which might interfere with the growth of crystal grains at a grain boundary. Further, this amorphous phase at the grain boundary possibly dissolves M elements such as Zr, Hr and Nb which are ejected from α—Fe when the heat treatment temperature is increased so as to prevent the formation of an Fe—M system compound which deteriorates the soft magnetic characteristics. It is thus important to add B to an Fe— Zr (Hf) system alloy.

Where the amount of B is less than 0.5 atomic %, since the amorphous phase at the grain boundary is made unstable, the addition effects cannot be sufficiently obtained. Where the amount of X exceeds 12 atomic %, since the tendency to form a B—M or Fe—B system boride is increased, heat treatment conditions for obtaining a fine crystalline structure are consequently limited, thereby making it impossible to obtain good soft magnetic characteristics. The B content is preferably less than 10 atomic % for obtaining a high saturation magnetic flux density of 1.5 T or more. However, since, with a B content within the range of 10 to 18 atomic %, the electric resistance of the alloy can be increased, and a leakage current loss at a high frequency can be decreased, the B content may be within the range of 10 to 18 atomic %.

The addition of an appropriate amount of B causes the fine crystalline phase precipitated to have an average crystal grain size of 30 nm or less.

It is necessary for easily obtaining the amorphous phase that the soft magnetic alloy having one of the compositions of the first to eight examples contains any one of Zr, Hf and Nb which have the high ability to form an amorphous substance. The element Zr, Hf or Nb can partially be replaced by Ti, V, Ta, Mo or W of the elements in Groups 4A to 6A.

In the alloy of the present invention, element M is the type having a relatively low diffusion speed, and is essential to fine the structure because the addition of element M possibly has the effect of decreasing the growth speed of fine crystalline nuclei. However, if the amount of element M added is less than 4 atomic %, the effect of decreasing the growth speed of nuclei is lost, and the crystal grain size is consequently increased, thereby making it impossible to obtain good soft magnetic characteristics. As for the Fe—Hf—B alloy, the average crystal grain size with Hf=5 atomic % is 13 nm, while the average grain size with Hf=3 atomic % is increased to 39 nm. With a Y amount more than 9 atomic %, the tendency to form an M—B or Fe—M system compound is increased, and good characteristics cannot be obtained. Further, a tape-formed alloy is made brittle after liquid quenching, thereby causing difficulties in working for producing a predetermined core shape. The Y content is thus within the range of 4 to 9 atomic %.

In the soft magnetic alloy having the composition of each of the second, fourth, sixth and eighth examples, ratio b of Fe, Co or Ni is 93 atomic % or less. This is because with ratio b of more than 93 atomic %, the amorphous single phase cannot be easily obtained by liquid quenching, and consequently, the structure of the alloy obtained after heat treatment is made nonuniform, and a high permeability cannot be obtained. It is preferred for obtaining a saturation magnetic flux density of 10 KG or more that ratio b is at least 75 atomic %, and ratio b is thus within the range of 75 to 93 atomic %.

Since oxides of Nb and Mo among the elements added have a small absolute value of formation free energy and are thermally stable, Nb and Mo are hardly oxidized in production of an alloy. Where such an element is added, therefore, an alloy can be produced at low cost under simple production conditions, and is advantageous for the cost. Specifically, the soft magnetic alloy containing such an element can be produced in air or a similar atmosphere while partly supplying an inert gas to the nozzle tip of a crucible used for quenching a melt.

Although the reasons for limiting the elements of the alloys according to the present invention are described above, a platinum group element such as Cr, Ru, Rh or Ir other than the above elements can be added for improving corrosion resistance. Since the addition of more than 5 atomic % of such a platinum group element deteriorates the saturation magnetic flux density, the adding amount must be limited to 5 atomic % or less. If required, Y, a rare earth element, an element such as Zn, Cd, Ga, In, Ge, Sn, Pb, As, Sb, Bi, Se, Te, Li, Be, Mg, Ca, Sr or Ba can be added for adjusting the magnetostriction of the alloy. Even if the alloy contains inevitable impurities such as H, N, O, S, etc. in amounts which do not deteriorate the desired characteristics, the composition of the alloy can of course be considered as the same as the compositions of the soft magnetic alloys according to the present invention.

The alloy is produced by mixing alloy materials so that the aforegoing composition can be obtained, and melting the resultant mixture to form an alloy melt, and then performing a liquid quenching process in which the melt is sprayed on a rotating copper metal roll. This liquid quenching process can form an amorphous ribbon. The thus-formed ribbon can be cut in required length and width, or punched in a desired shape to be used for a transformer, a magnetic head, etc.

Heat treatment comprising heating at 500 to 700° C. and then cooling is preferably performed after working. The heat treatment precipitates the fine crystalline phase in an amorphous phase and thus improve the magnetic characteristics.

The production of a transformer core by using an alloy ribbon having the above composition is described.

Figure 1B:
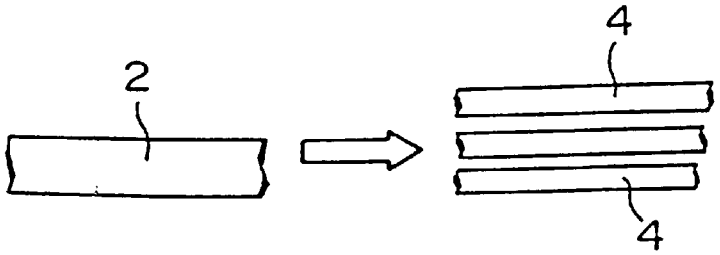
Figure 2A:
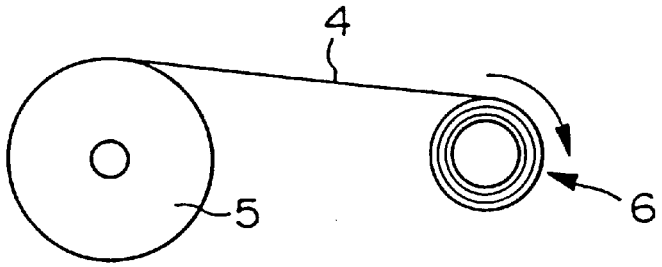
FIG. 2(*a*) is a side view showing the state where a cut ribbon is wound to produce a body of a troidal core, and FIG. 2(*b*) is a drawing showing the same state.
Figure 2B:
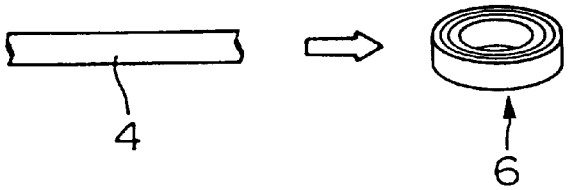

An alloy ribbon 2 having the aforegoing composition is prepared, and wound on a winding frame 1, as shown in FIG. 1(*a*). The ribbon 2 is cut in a plurality of ribbons 4 having a predetermined width by a cutting device 3 such as a roller cutter while being drawn out from the winding frame 1, and wound on another winding frame 5. In this process, in continuous cutting of the long ribbon 2, the cutter portion of the cutting device 3 is heated, and the cut portions of the ribbon 2 are partly heated to about 200 to 300° C. However, the alloy having the above composition is not made brittle within the temperature region of 200 to 300° C., the ribbon is not damaged in cutting.

Each of the ribbons 4 is then drawn out from the winding frame 5, and then wound in a roll together with an insulating tape to form a magnetic core body (toroidal core body) 6. The insulating tape is used for preventing layer dielectric breakage during driving at a high voltage and decreasing a eddy current loss to suppress the generation of heat. As the insulating tape, a resin film or resin tape, an inorganic material film or inorganic material tape, or a resin tape which is coated with inorganic particles of alumina, magnesia, boron nitride, quartz sand or quartz or water-glass in which such inorganic particles are dispersed, and, if required, then baked is appropriately used.

Examples of resin materials which can be used for forming the insulating tape include a solvent type varnish tape comprising an alkyd resin dissolved in an organic solvent, a non-solvent type varnish tape comprising styrene monomer and unsaturated polyester resin, an acrylic resin, a polyester resin, an epoxy ester resin and the like.

Instead of simultaneously winding the ribbon 4 and the insulating tape 4, the ribbon 4 may be coated with an insulating layer and then wound. The ribbon 4 can be coated with the insulating layer by, for example, appropriately using an electrophoretic method for making to adhere inorganic particles to the surface of the ribbon 4, a flame spray coating method, a sputtering or vacuum evaporation method for coating an inorganic layer. The insulating layer can also be formed by injecting, into a resin, quartz sand or quartz singly or in mixture thereof.

Figure 3:
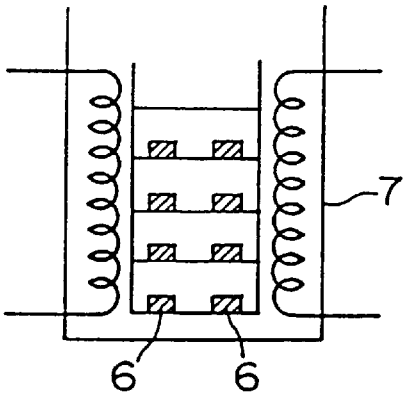
FIG. 3 is a sectional view showing the state where the troidal core body is heat-treated.

After the magnetic core body 6 is formed, the magnetic core body 6 is inserted into a heating furnace 7 as shown in FIG. 3 and heated to 500 to 700° C. to produce a fine crystalline phase in the ribbon 4. This heat treatment improves the soft magnetic characteristics of the soft magnetic alloy which constitutes the ribbon, and increases the hardness thereof.

Figure 4A:
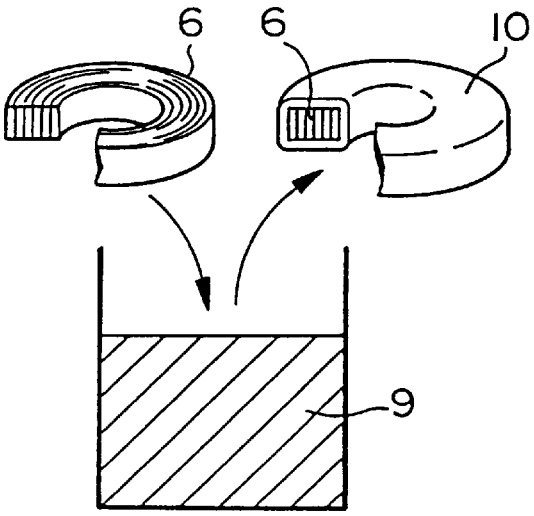
FIG. 4(*a*) is a sectional view showing the state where the troidal core body heat-treated is coated with a resin, and FIG. 4(*b*) is an exploded perspective view showing the state where the troidal core body heat-treated is contained in a case.
Figure 4B:
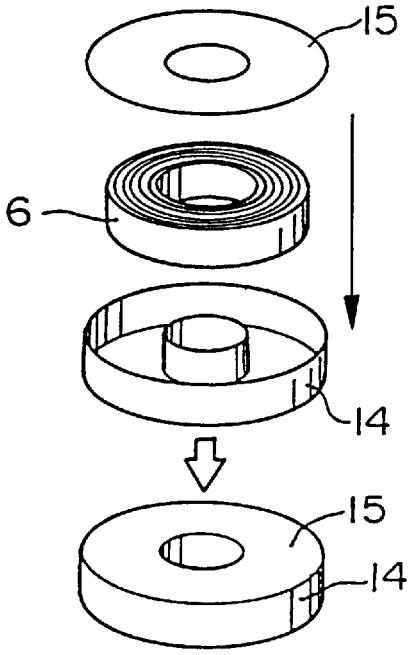
Figure 5:
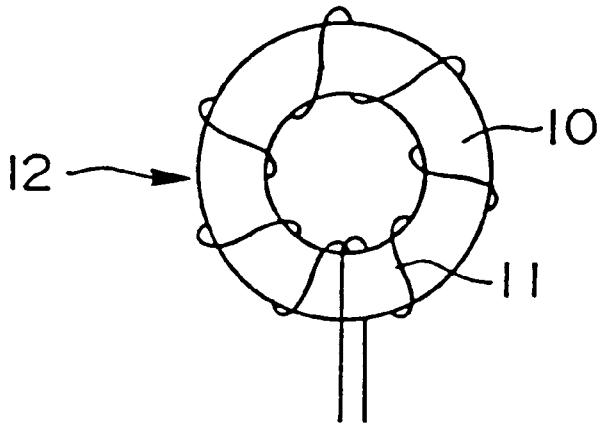
FIG. 5 is a perspective view showing an example of the completed toroidal core.

The magnetic core body 6 is then dipped in a resin solution 9 to form a resin coating 10, as shown in FIG. 4(*a*), and a wire 11 is wound as shown in FIG. 5 to obtain the toroidal core (laminated magnetic core) 12 shown in FIG. 5. In the above process, in stead of resin coating, the magnetic core body 6 may be contained in a housing case comprising a container 14 and a cover 15, as shown in FIG. 4(*b*), and then subjected to wiring to produce the toroidal core.

In the production of the toroidal core 12 through the aforegoing steps, even if there is a step such as the cutting step including partial heating in the course of the production, the toroidal core 12 can be produced without damaging the ribbon due to embrittlement so far as the ribbon comprises the alloy having the aforegoing composition.

Since the thus-obtained toroidal core 12 mainly comprises the soft magnetic alloy having the aforegoing composition, the core exhibits an excellent saturation magnetic flux density of about 1.3 to 1.64 T (Tesla), lower core loss within a frequency region of about 100 kHz, less heat generation and no deterioration in characteristics. This thus contributes to the production of the small lightweight toroidal core 12.

Although, in the above embodiment, the toroidal core 12 is produced by winding the ribbon 4, a laminated magnetic core may be formed by laminating rings which are punched out from the ribbon 4.

Figure 6:
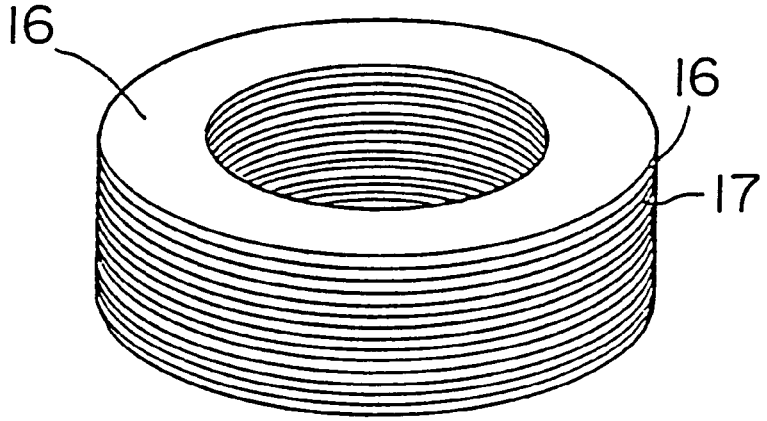
FIG. 6 is a perspective view showing a magnetic core in accordance with a second embodiment of the present invention.

FIG. 6 shows a laminated magnetic core in accordance with a second embodiment which is formed by laminating the rings. The laminated magnetic core B of this embodiment comprises a plurality of rings 16 which are made of the soft magnetic alloy having the above composition and which are laminated with insulating layers 17 between the respective rings 16.

The soft magnetic alloy used for forming the rings 16 may be equivalent to the soft magnetic alloy used for forming the ribbon 1 of the aforegoing magnetic core A, and the material used for forming the insulating layers 17 may also be equivalent to the insulating layer 2 of the aforegoing magnetic core A.

Since the magnetic core B having a structure in accordance with this embodiment is formed by laminating the rings 16 exhibiting excellent soft magnetic characteristics, the core exhibits excellent soft magnetic characteristics and a low core loss. This contributes to the formation of a small lightweight magnetic core.

EXAMPLES

Each of alloy melts having various compositions was quenched by spraying it on the surface of a rotating copper roll under a pressure of Ar gas through nozzles disposed above the copper roll to obtain a plurality of alloy ribbons having a thickness of 20 to 23 μm. The resultant samples of the alloy ribbons respectively had the composition $Fe_{90}Zr_7B_3$ (thickness of 20 μm), the composition $Fe_{94}Nb_7B_9$ (thickness of 22 μm), and the composition $Fe_{73.50}Si_{13.5}B_9Nb_3Cu_1$ (thickness of 21 μm) Each of the ribbon samples was then annealed at various temperatures, and then subjected to flexural tests for measuring fracture strain.

The flexural test was carried out by a method in which a ribbon sample was arranged in parallel to two rods and held between the ends of the two rods, and was then bent to an angular form by gradually bringing the two rods near each other. Assuming that the space between the rod ends when the ribbon was cut by bending it to an angular form is L, and the thickness of the ribbon is t, the value of t/(L−t) was defined as the fracture strain (λf). The results obtained are shown in FIG. 7.

Figure 7:
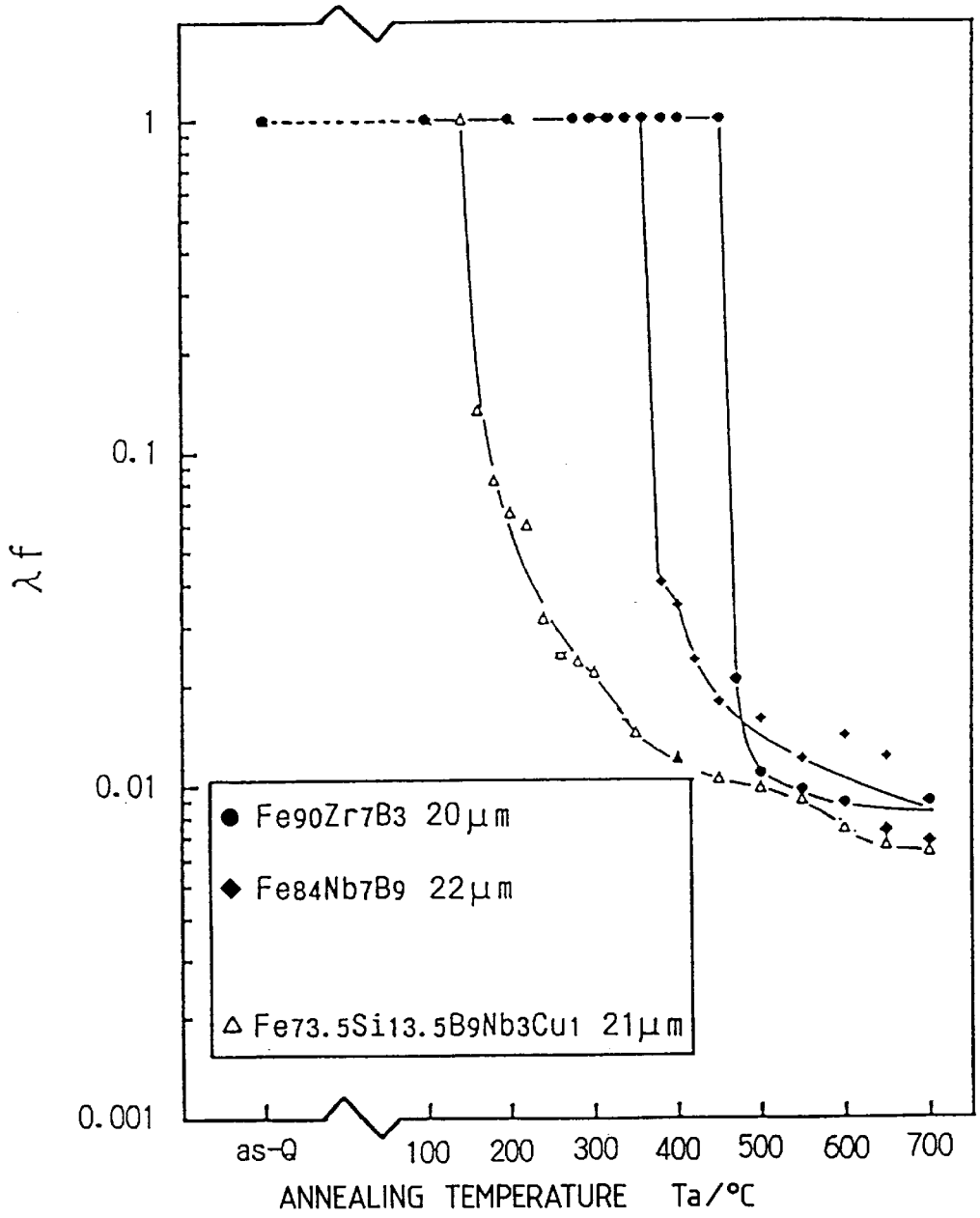
FIG. 7 is a graph showing the relations between fracture strain and annealing temperature of alloy samples according to the present invention.

In FIG. 7, a fracture strain (λf) of 1 means that the ribbon could be bent without breaking until the two rods contacted each other with the bent ribbon therebetween. A lower value than 1 means that the ribbon was broken in the course of bending to an angular form.

The results shown in FIG. 7 reveal that each of the soft magnetic alloy samples respectively having the compositions $Fe_{90}Zr_7B_3$ and $Fe_{84}Nb_7B_9$ according to the present invention has a temperature of 380 to 500° C. at which the fracture strain begins to decrease, and is thus hardly made brittle after annealing treatment at 400 to 500° C., and that the comparative alloy sample having the composition $Fe_{73.5}Si_{13.5}B_9Nb_3Cu_1$ is made very brittle by annealing treatment at 100 to 200° C.

Figure 8:
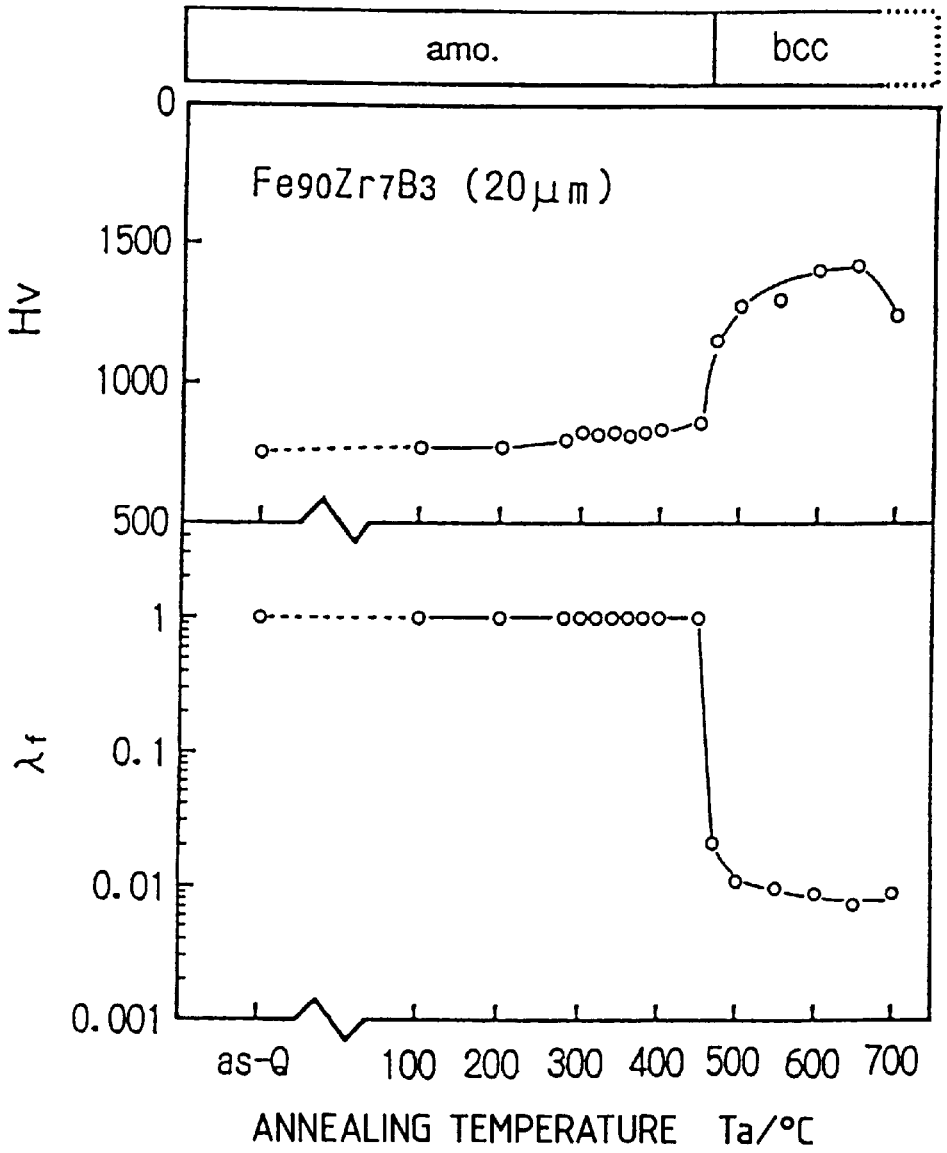
FIG. 8 is a graph showing the relations between fracture strain, hardness and annealing temperature of alloy samples according to the present invention.

FIG. 8 shows the results of measurement of the dependency of fracture strain and hardness (Hv) on annealing temperature with respect to the sample having the composition $Fe_{90}Zr_7B_3$.

The results shown in FIG. 8 reveal that since the heat treatment at about 450° C. or more starts to increase the hardness of the alloy sample having this composition, and decrease the fracture strain thereof, this alloy sample is not made brittle even by working at a temperature of 450° C. or less in the course of the production process.

Figure 9:
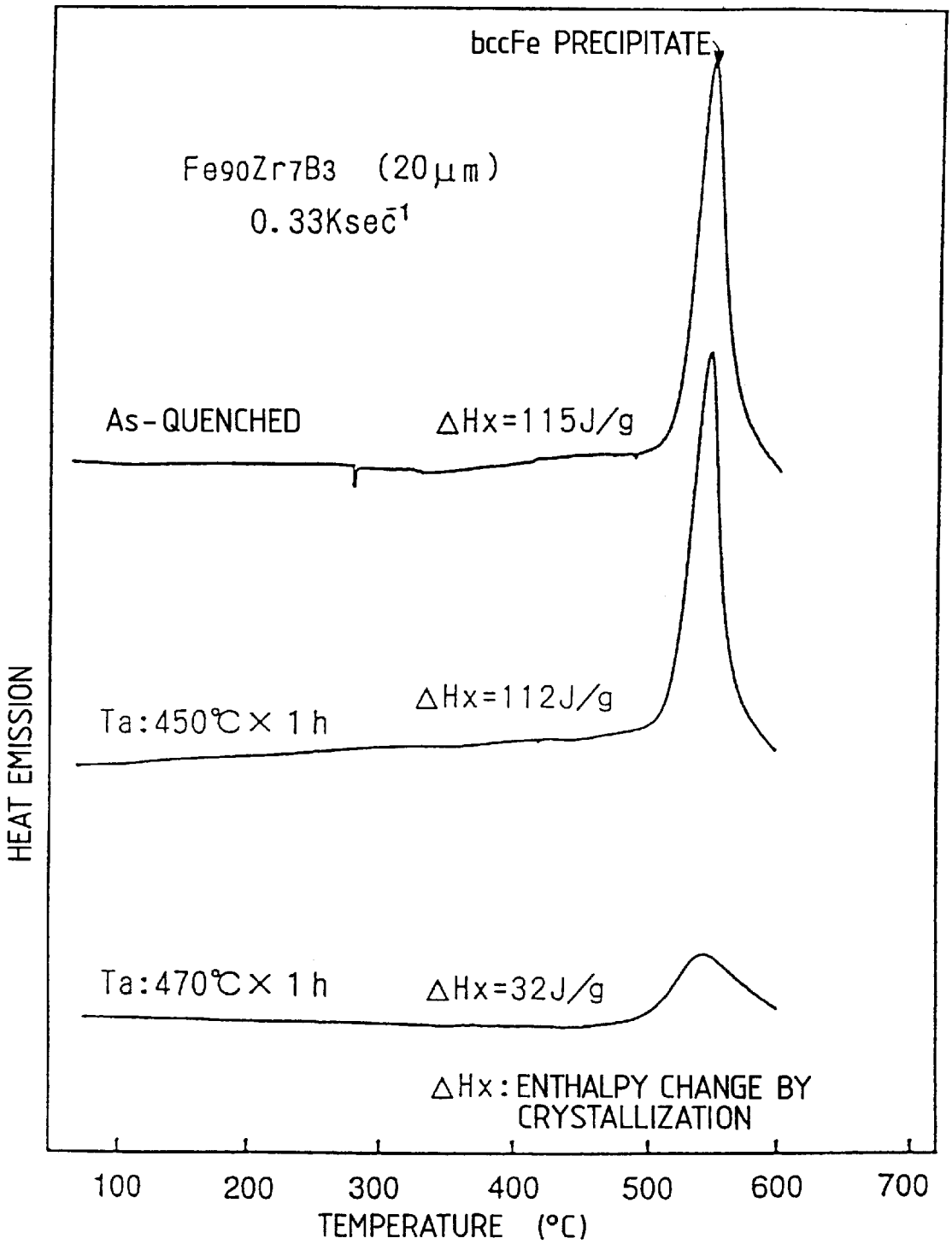
FIG. 9 is a graph showing the crystallization temperatures of alloy samples according to the present invention.

FIG. 9 shows the crystallization start temperature of the sample used in FIG. 8. The results shown in FIG. 9 reveal that when As-quenched (not heat-treated after quenching) sample, a sample heat-treated at 450° C. for 1 hr. and a sample heat-treated at 470° C. for 1 hr. were heated at a temperature of about 550° C., all samples show emission of heat by precipitation of Fe having the bcc structure to be changed to a fine crystalline structure.

Figure 10:
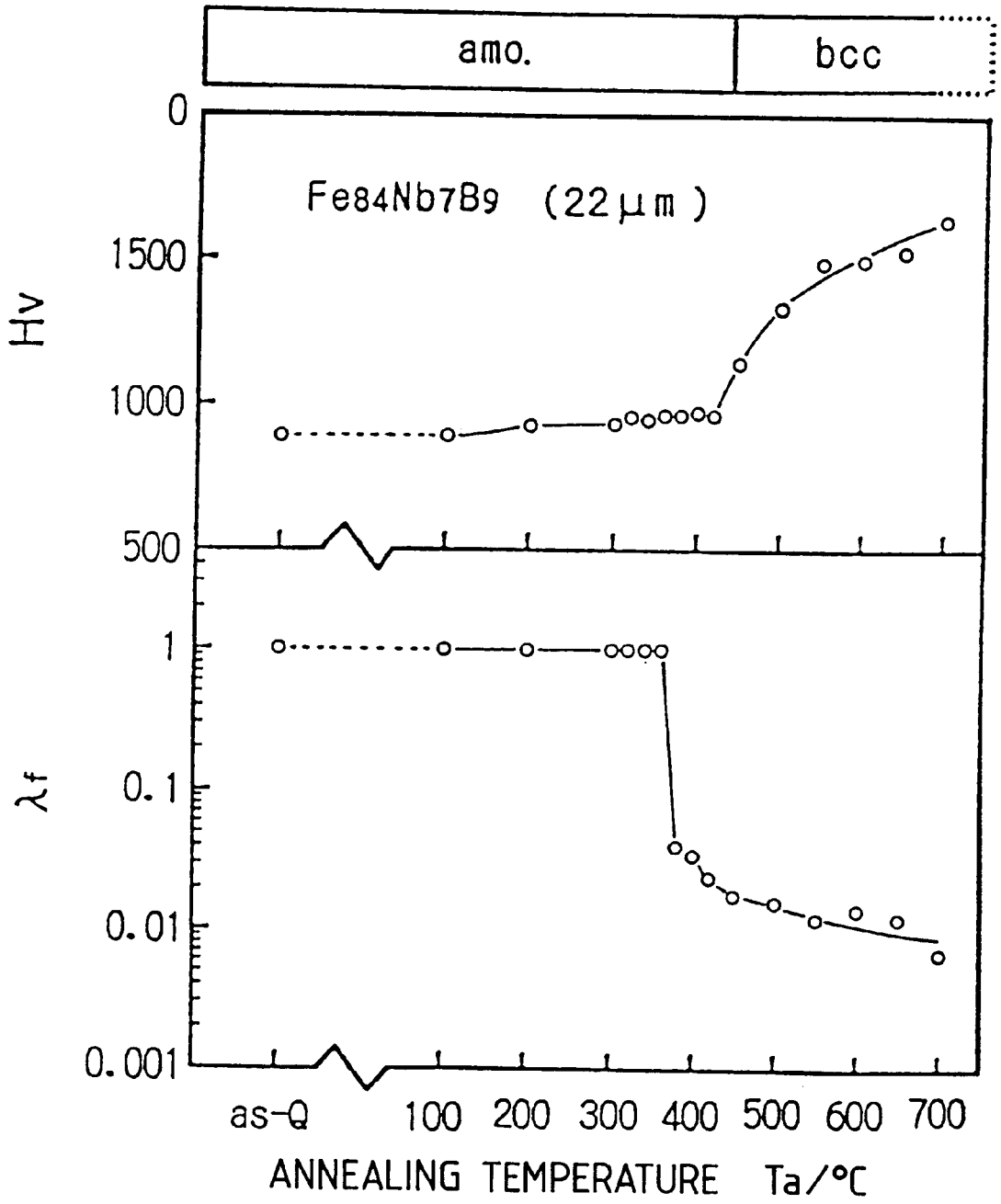
FIG. 10 is a graph showing the relations between fracture strain, hardness and annealing temperature of other alloy samples according to the present invention.

FIG. 10 shows the results of measurement of the dependency of fracture strain and hardness on annealing temperature with respect to the sample (thickness 22 μm) having the composition $Fe_{84}Nb_7B_9$.

The results shown in FIG. 10 reveal that since the heat treatment at about 350° C. or more starts to increase the hardness of the alloy sample having this composition, and decrease the fracture strain thereof, this alloy sample is not made brittle even by working at a temperature of 350° C. or less in the course of the production process.

Figure 11:
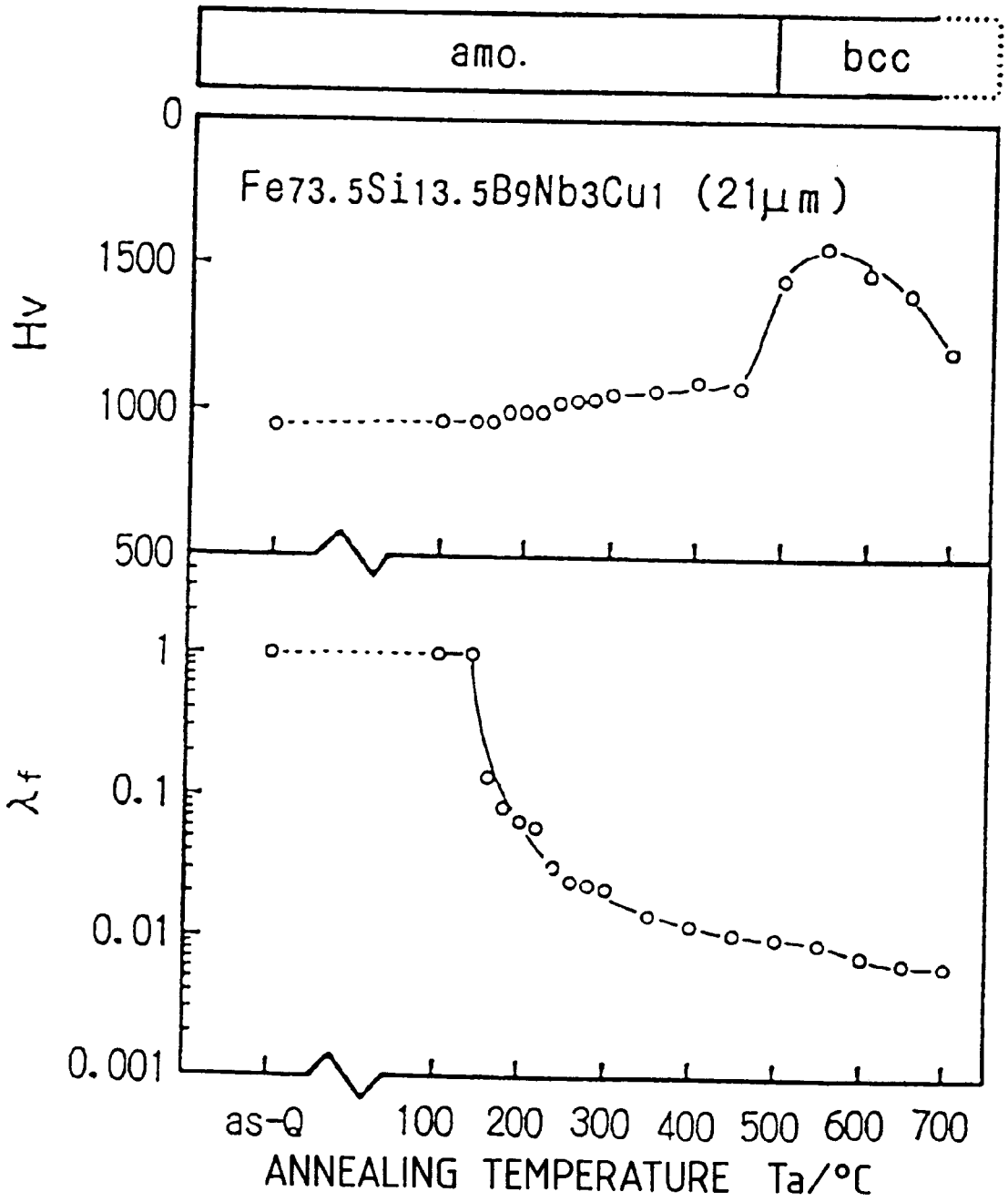
FIG. 11 is a graph showing the relations between fracture strain, hardness and annealing temperature of alloy samples of comparative examples.

FIG. 11 shows the results of measurement of the dependency of fracture strain and hardness on annealing temperature with respect to the sample (thickness 21 μm) having the composition $Fe_{73.5}Si_{13.5}B_9Nb_3Cu_1$.

The results shown in FIG. 11 reveal that since the heat treatment at about 150° C. or more starts to increase the hardness of the alloy sample having this composition, and decrease the fracture strain thereof, this alloy sample is made brittle by working at a temperature of 150° C. to 250 ° C. in the course of the production process.

The embrittlement of this system of alloy at such a temperature is possibly caused by the inclusion of Cu which has low solid solubility in Fe and the tendency of phase separation. Namely, it is presumed that an alloy containing Fe and Cu is made brittle due to the significant tendency that the amorphous phase becomes nonuniform.

A material was prepared so as to have each of the compositions shown in Table 1, and was then melted with a high frequency in a crucible with a nozzle to obtain an alloy melt. The resulting alloy melt was quenched by the liquid quenching method of spraying the melt on a copper roll rotating at a high speed from the nozzle to obtain an alloy ribbon having a thickness of 15 to 20 $\mu$m.

The thus-obtained ribbon was punched in the form of a ring having an outer diameter of 10 mm and an inner diameter of 6 mm, and the thus-obtained ring was heat-treated at 600 to 650° C. for 1 hour, and then subjected to insulating treatment by applying insulating paper thereto. 20 rings subjected to such insulating treatment were laminated to form a magnetic core, followed by wiring. The core loss of the resulting core was measured by using an alternating current magnetization tester (MMS0375) produced by Ryowa Densi K. K. The results of the measurement are shown in Table 1.

TABLE 1

| No | Composition | Saturation magnetic flux density Bs (T) | Core loss 100 kHz, 0.2 T (W/kg) |
|---|---|---|---|
| 1 | $Fe_{91}Zr_7B_2$ | 1.70 | 76.3 |
| 2 | $Fe_{90}Zr_7B_3$ | 1.63 | 79.7 |
| 3 | $Fe_{89}Hf_7B_4$ | 1.59 | 59.0 |
| 4 | $Fe_{84}Nb_7B_9$ | 1.50 | 75.7 |
| 5 | $Fe_{90}Zr_6B_4$ | 1.60 | 85.7 |
| 6 | $Fe_{89}Zr_8B_3$ | 1.48 | 146.5 |
| 7 | $Fe_{90}Zr_8B_2$ | 1.54 | 67.2 |
| 8 | $Fe_{86}Nb_6B_8$ | 1.64 | 65.4 |
| 9 | $Fe_{85}Nb_6B_9$ | 1.62 | 48.3 |
| 10 | $Fe_{86}Nb_7B_8$ | 1.52 | 56.4 |
| 11 | $Fe_{84}Nb_6B_{10}$ | 1.59 | 50.5 |
| 12 | $Fe_{83}Nb_6B_{11}$ | 1.54 | 48.2 |
| 13 | $Fe_{82}Nb_6B_{12}$ | 1.49 | 56.9 |
| 14 | $Fe_{81}Nb_6B_{13}$ | 1.48 | 54.4 |
| 15 | $Fe_{80}Nb_6B_{14}$ | 1.42 | 58.6 |
| 16 | $Fe_{79}Nb_6B_{15}$ | 1.40 | 61.7 |
| 17 | $Fe_{76}Nb_6B_{18}$ | 1.30 | 123.7 |
| 18 | $Fe_{83}Nb_5B_{12}$ | 1.58 | 79.1 |
| 19 | $Fe_{81}Nb_5B_{14}$ | 1.55 | 65.2 |
| 20 | $Fe_{82}Nb_7B_9Si_2$ | 1.42 | 70.6 |
| 21 | $Fe_{83}Nb_7B_9A$ | 1.51 | 50.4 |
| 22 | $Fe_{83}Nb_7B_9Ge_1$ | 1.52 | 69.2 |
| 23 | $Fe_{83}Nb_7B_9Ga_1$ | 1.53 | 51.1 |
| 24 | $(Fe_{0.985}Co_{0.015})_{90}Zr_7B_3$ | 1.64 | 64.8 |
| 25 | $(Fe_{0.99}Ni_{0.01})_{90}Zr_7B_3$ | 1.64 | 72.4 |
| 26 | $(Fe_{0.90}Ni_{0.10})_{90}Zr_7B_3$ | 1.62 | 103.3 |
| 27 | $(Fe_{0.99}Ni_{0.01})_{84}Nb_7B_9$ | 1.50 | 70.5 |
| 28 | $(Fe_{0.90}Ni_{0.10})_{82}Nb_6B_{12}$ | 1.45 | 63.7 |
| 29 | $(Fe_{0.85}Ni_{0.15})_{82}Nb_6B_{12}$ | 1.51 | 87.1 |
| 30 | $Fe_{89}Zr_6Nb_1B_4$ | 1.58 | 82.2 |
| 31 | $Fe_{86.5}Zr_3Nb_4B_{6.5}$ | 1.49 | 74.6 |
| 32 | Fe—Si—B amorphous alloy | 1.56 | 168.0 |
| 33 | Fe—Si—B—Cr amorphous alloy | 1.41 | 89.2 |
| 34 | $Fe_{74}Nb_6B_{20}$ | 1.25 | 231.4 |

As can be seen from the results shown in Table 1, the magnetic cores according to the present invention exhibit an excellent saturation magnetic flux density within the range of 1.4 to 1.64 tesla (T), and low core loss at 100 kHz, and thus have very excellent characteristics.

As described above, the soft magnetic alloy having the specified composition according to the present invention show a fracture strain of 1 at 300° C. or less, and is thus not made brittle even by heat treatment at 100 to 300° C. The soft magnetic alloy can thus be subjected to machining such as warm press working, punching, etc. and cutting, and has the characteristics of high saturation magnetic flux density and low core loss even after working.

Since the laminated magnetic core formed by using the soft magnetic alloy having the specified composition is not made brittle even by heating at 300° C. or less at a step in the course of the production thereof, the laminated magnetic core is not made brittle even it is produced by machining such as warm press, punching, or the like, or processing such as cutting, and then winding, thereby obtaining intended high saturation magnetic flux density and low core loss.

In addition, comparison with a magnetic core formed by using the Fe—Si—B amorphous alloy which is known as exhibiting excellent soft magnetic characteristics shows that the laminated magnetic core according to the present invention exhibits excellent saturation magnetic flux density equivalent to that of the Fe—Si—B amorphous alloy, and lower core loss than that of the Fe—Si—B amorphous alloy. The present invention can thus provide a small lightweight laminated magnetic core having a low loss within a high frequency region and a high saturation magnetic flux density.

The laminated magnetic core formed by using the soft magnetic alloy ribbon having the specified composition according to the present invention also has a high saturation magnetic flux density and low core loss. Particularly, comparison with a magnetic core formed by using the Fe—Si—B amorphous alloy which is known as exhibiting excellent soft magnetic characteristics shows that the laminated magnetic core according to the present invention exhibits excellent saturation magnetic flux density equivalent to that of the Fe—Si—B amorphous alloy, and lower core loss than that of the Fe—Si—B amorphous alloy. The present invention can thus provide a small lightweight laminated magnetic core having a low loss within a high frequency region and a high saturation magnetic flux density.

What is claimed is:

1. A method for forming a magnetic core from an Fe-base soft magnetic alloy consisting of a composition expressed by the following general formula:

$$Fe_bB_xM_y$$

wherein M is at least one element selected from a group consisting of Ti, Zr, Hf, V, Nb, Ta, Mo and W, and composition ratios b, x and y satisfy the relations b=75 to 93 atomic %, x=0.5 to 18 atomic %, and y=4 to 9 atomic %, respectively, the method comprising the steps of:

forming an amorphous ribbon portion consisting of said Fe-base soft magnetic alloy;

forming a magnetic core body including said amorphous ribbon portion; and heat treating the magnetic core body at a temperature in the range of 500 to 700° C. such that a crystalline structure is produced in said amorphous ribbon portion, the crystalline structure comprising fine crystalline grains having an average crystalline grain size of 30 nm or less and a body-centered cubic structure, wherein the step of forming said amorphous ribbon portion comprises melting alloy materials to form an alloy melt, quenching the alloy melt to form an amorphous ribbon, heating the amorphous ribbon to a temperature in the range of 200 to 300° C., and cutting the heated amorphous ribbon to form said amorphous ribbon portion, wherein said Fe-base soft magnetic alloy is formed such that the amorphous ribbon portion has a fracture strain of 1 after said step of heating in the range of 200 to 300° C.

2. The method of claim 1, wherein the step of forming said magnetic core body comprises winding said amorphous ribbon portion onto a roll with an insulating material disposed between adjacent layers of the roll.

3. The method of claim 1, wherein the step of forming said magnetic core body comprises forming a plurality of rings, each of said plurality of rings being formed from said amorphous ribbon portion, and laminating said plurality of rings with resin material disposed between adjacent pairs of rings.

4. A method for forming a magnetic core from an Fe-base soft magnetic alloy consisting of a composition expressed by the following general formula:

$$(Fe_{1-a}Co_a)_bB_xM_y$$

wherein M is at least one element selected from a group consisting of Ti, Zr, Hf, V, Nb, Ta, Mo and W, and composition ratios a, b, x and y satisfy the relations a ≦0.2, b=75 to 93 atomic %, x=0.5 to 18 atomic %, and y=4 to 9 atomic % respectively, the method comprising the steps of:

forming an amorphous ribbon portion consisting of said Fe-base soft magnetic alloy;

forming a magnetic core body including said amorphous ribbon portion; and heat treating the magnetic core body at a temperature in the range of 500 to 700° C. such that a crystalline structure is produced in said amorphous ribbon portion, the crystalline structure comprising fine crystalline grains having an average crystalline grain size of 30 nm or less and a body-centered cubic structure, wherein the step of forming said amorphous ribbon portion comprises melting alloy materials to form an alloy melt, quenching the alloy melt to form an amorphous ribbon, heating the amorphous ribbon to a temperature in the range of 200 to 300° C., and cutting the heated amorphous ribbon to form said amorphous ribbon portion, wherein said Fe-base soft magnetic alloy is formed such that the amorphous ribbon portion has a fracture strain of 1 after said step of heating in the range of 200 to 300° C.

5. The method of claim 4, wherein the step of forming said magnetic core body comprises winding said amorphous ribbon portion onto a roll with an insulating material disposed between adjacent layers of the roll.

6. The method of claim 4, wherein the step of forming said magnetic core body comprises forming a plurality of rings, each of said plurality of rings being formed from said amorphous ribbon portion, and laminating said plurality of rings with resin material disposed between adjacent pairs of rings.

7. A method for forming a magnetic core from an Fe-base soft magnetic alloy consisting of a composition expressed by the following general formula:

$$Fe_bB_xM_yX_z$$

wherein M is at least one element selected from a group consisting of Ti, Zr, Hf, V, Nb, Ta, Mo and W, X is at least one of Cr, Ru, Rh and Ir, and composition ratios b, x, y and z satisfy the relations b=75 to 93 atomic %, x=0.5 to 18 atomic %, y=4 to 9 atomic %, and z≦0.5 atomic %, respectively, the method comprising the steps of:

forming an amorphous ribbon portion consisting of said Fe-base soft magnetic alloy;

forming a magnetic core body including said amorphous ribbon portion; and heat treating the magnetic core body at a temperature in the range of 500 to 700° C. such that a crystalline structure is produced in said amorphous ribbon portion, the crystalline structure comprising fine crystalline grains having an average crystalline grain size of 30 nm or less and a body-centered cubic structure, wherein the step of forming said amorphous ribbon portion comprises melting alloy materials to form an alloy melt, quenching the alloy melt to form an amorphous ribbon, heating the amorphous ribbon to a temperature in the range of 200 to 300° C., and cutting the heated amorphous ribbon to form said amorphous ribbon portion, wherein said Fe-base soft magnetic alloy is formed such that the amorphous ribbon portion has a fracture strain of 1 after said step of heating in the range of 200 to 300° C.

8. The method of claim 7, wherein the step of forming said magnetic core body comprises winding said amorphous ribbon portion onto a roll with an insulating material disposed between adjacent layers of the roll.

9. The method of claim 7, wherein the step of forming said magnetic core body comprises forming a plurality of rings, each of said plurality of rings being formed from said amorphous ribbon portion, and laminating said plurality of rings with resin material disposed between adjacent pairs of rings.

10. A method for forming a magnetic core from an Fe-base soft magnetic alloy consisting of a composition expressed by the following general formula:

$$(Fe_{1-a}CO_a)_bB_xM_yX_z$$

wherein M is at least one element selected from a group consisting of Ti, Zr, Hf, V, Nb, Ta, Mo and W, X is at least one of Cr, Ru, Rh and Ir; and composition ratios a, b, x, y and z satisfy the relations a≦0.2, b=75 to 93 atomic %, x=0.5 to 18 atomic %, y=4 to 9 atomic %, and z≦0.5 atomic %, respectively, the method comprising the steps of:

forming an amorphous ribbon portion consisting of said Fe-base soft magnetic alloy;

forming a magnetic core body including said amorphous ribbon portion; and heat treating the magnetic core body at a temperature in the range of 500 to 700° C. such that a crystalline structure is produced in said amorphous ribbon portion, the crystalline structure comprising fine crystalline grains having an average crystalline grain size of 30 nm or less and a body-centered cubic structure, wherein the step of forming said amorphous ribbon portion comprises melting alloy materials to form an alloy melt, quenching the alloy melt to form an amorphous ribbon, heating the amorphous ribbon to a temperature in the range of 200 to 300° C., and cutting the heated amorphous ribbon to form said amorphous ribbon portion, wherein said Fe-base soft magnetic alloy is formed such that the amorphous ribbon portion has a fracture strain of 1 after said step of heating in the range of 200 to 300° C.

11. The method of claim 10, wherein the step of forming said magnetic core body comprises winding said amorphous ribbon portion onto a roll with an insulating material disposed between the adjacent layers of the roll.

12. The method of claim 10, wherein the step of forming said magnetic core body comprises forming a plurality of rings, each of said plurality of rings being formed from said amorphous ribbon portion, and laminating said plurality of rings with resin material disposed between adjacent pairs of rings.

13. A method for forming a magnetic core from an Fe-base soft magnetic alloy consisting of a composition expressed by the following general formula:

$$Fe_bB_xM_yX'_t$$

Wherein M is at least one element selected from a group consisting of Ti, Zr, Hf, V, Nb, Ta, Mo and W, X' is at least one of Si, Al, Ge; and composition rations b, x, y and z satisfy the relations b=75 to 93 atomic %, x=0.5 to 18 atomic %, y=4 to 9 atomic %, z≦0.5 atomic % and t≦4 atomic %, respectively, the method comprising the steps of:

forming an amorphous ribbon portion consisting of said Fe-base soft magnetic alloy;

forming a magnetic core body including said amorphous ribbon portion; and heat treating the magnetic core body at a temperature in the range of 500 to 700° C. such that a crystalline structure is produced in said amorphous ribbon portion, the crystalline structure comprising fine crystalline grains having an average crystalline grain size of 30 nm or less and a body-centered cubic structure, wherein the step of forming said amorphous ribbon portion comprises melting alloy materials to form an alloy melt, quenching the alloy melt to form an amorphous ribbon, heating the amorphous ribbon to a temperature in the range of 200 to 300° C., and cutting the heated amorphous ribbon to form said amorphous ribbon portion, wherein said Fe-base soft magnetic alloy is formed such that the amorphous ribbon portion has a fracture strain of 1 after said step of heating in the range of 200 to 300° C.

14. The method of claim 13, wherein the step of forming said magnetic core body comprises winding said amorphous ribbon portion onto a roll with an insulating material disposed between adjacent layers of the roll.

15. A method of claim 13, wherein the step of forming said magnetic core body comprises forming a plurality of rings, each of said plurality of rings being formed from said amorphous ribbon portion, and laminating said plurality of rings with resin material disposed between adjacent pairs of rings.

16. A method for forming a magnetic core from an Fe-base soft magnetic alloy consisting of a composition expressed by the following general formula:

$$(Fe_{1-a}Co_a)_bB_xM_yX'_t$$

wherein M is at least one element selected from a group consisting of Ti, Zr, Hf, V, Nb, Ta, Mo and W, X' is at least one of Si, Al, Ge and Ga; and composition ratios a, b, x, y and t satisfy the relations a≦0.2., b=75 to 93 atomic %, x=0.5 to 18 atomic %, y=4 to 9 atomic %, and t≦4 atomic %, respectively, the method comprising the steps of:

forming an amorphous ribbon portion consisting of said Fe-base soft magnetic alloy;

forming a magnetic core body including said amorphous ribbon portion; and heat treating the magnetic core body at a temperature in the range of 500 to 700° C. such that a crystalline structure is produced in said amorphous ribbon portion, the crystalline structure comprising fine crystalline grains having an average crystalline grain size of 30 nm or less and a body-centered cubic structure, wherein the step of forming said amorphous ribbon portion comprises melting alloy materials to form an alloy melt, quenching the alloy melt to form an amorphous ribbon, heating the amorphous ribbon to a temperature in the range of 200 to 300° C., and cutting the heated amorphous ribbon to form said amorphous ribbon portion, wherein said Fe-base soft magnetic alloy is formed such that the amorphous ribbon portion has a fracture strain of 1 after said step of heating in the range of 200 to 300° C.

17. The method of claim 16, wherein the step of forming said magnetic core body comprises winding said amorphous ribbon portion onto a roll with an insulating material disposed between adjacent layers of the roll.

18. The method of claim 16, wherein the step of forming said magnetic core body comprises forming a plurality of rings, each of said plurality of rings being formed from said amorphous ribbon portion, and laminating said plurality of rings with resin material disposed between adjacent pairs of rings.

19. A method for forming a magnetic core from an Fe-base soft magnetic alloy consisting of a composition expressed by the following general formula:

$$Fe_bB_xM_yX_zX'_t$$

wherein M is at least one element selected from a group consisting of Ti, Zr, Hf, V, Nb, Ta, Mo and W, X is at least one of Cr, Ru, Rh and Ir; X' is at least one of Si, Al, Ge and Ga; and composition ratios b, x, y, z and t satisfy the relations b=75 to 93 atomic %, x=0.5 to 18 atomic %, y=4 to 9 atomic %, z≦0.5 atomic % and t≦4 atomic % respectively, the method comprising the steps of:

forming an amorphous ribbon portion consisting of said Fe-base soft magnetic alloy;

forming a magnetic core body including said amorphous ribbon portion; and heat treating the magnetic core body at a temperature in the range of 500 to 700° C. such that a crystalline structure is produced in said amorphous ribbon portion, the crystalline structure comprising fine crystalline grains having an average crystalline grain size of 30 nm or less and a body-centered cubic structure;

wherein the step of forming said amorphous ribbon portion comprises melting alloy materials to form an alloy melt, quenching the alloy melt to form an amorphous ribbon, heating the amorphous ribbon to a temperature in the range of 200 to 300° C., and cutting the heated amorphous ribbon to form said amorphous ribbon portion, wherein said Fe-base soft magnetic alloy is formed such that the amorphous ribbon portion has a fracture strain of 1 after said step of heating in the range of 200 to 300° C.

20. The method of claim 19, wherein the step of forming said magnetic core body comprises winding said amorphous ribbon portion onto a roll with an insulating material disposed between adjacent layers of the roll.

21. The method of claim 19, wherein the step of forming said magnetic core body comprises forming a plurality of rings, each of said plurality of rings being formed from said amorphous ribbon portion, and laminating said plurality of rings with resin material disposed between adjacent pairs of rings.

22. A method for forming a magnetic core from an Fe-base soft magnetic alloy consisting of a composition expressed by the following general formula:

$$(Fe_{1-a}Co_a)_bB_xM_yX_zX'_t$$

wherein M is at least one element selected from a group consisting of Ti, Zr, Hf, V, Nb, Ta, Mo and W, X is at least one of Cr, Ru, Rh and Ir; X' is at least one of Si, Al, Ge and Ga; and composition ratios a, b, x, y, z and t satisfy the relations a ≦0.2, b=75 to 93 atomic %, x=0.5 to 18 atomic %, y=4 to 9 atomic %, z≦0.5 atomic %, and t≦4 atomic % respectively, the method comprising the steps of:

forming an amorphous ribbon portion consisting of said Fe-base soft magnetic alloy;

forming a magnetic core body including said amorphous ribbon portion; and heat treating the magnetic core body at a temperature in the range of 500 to 700° C. such that a crystalline structure is produced in said amorphous ribbon portion, the crystalline structure comprising fine crystalline grains having an average crystalline grain size of 30 nm or less and a body-centered cubic structure, wherein the step of forming said amorphous ribbon portion comprises melting alloy materials to form an alloy melt, quenching the alloy melt to form an amorphous ribbon, heating the amorphous ribbon to a temperature in the range of 200 to 300° C., and cutting the heated amorphous ribbon to form said amorphous ribbon portion, wherein said Fe-base soft magnetic alloy is formed such that the amorphous ribbon portion has a fracture strain of 1 after said step of heating in the range of 200 to 300° C.

23. The method of claim 22, wherein the step of forming said magnetic core body comprises winding said amorphous ribbon portion onto a roll with an insulating material disposed between adjacent layers of the roll.

24. The method of claim 22, wherein the step of forming said magnetic core body comprises forming a plurality of rings, each of said plurality of rings being formed from said amorphous ribbon portion, and laminating said plurality of rings with resin material disposed between adjacent pairs of rings.

* * * * *

UNITED STATES PATENT AND TRADEMARK OFFICE

CERTIFICATE OF CORRECTION

PATENT NO. : 5,935,347

DATED : August 10, 1999

INVENTOR(S) : Kiyonori Suzuki et al.

It is certified that error appears in the above-identified patent and that said Letters Patent is hereby corrected as shown below:

In claim 13, line 9, change "rations" to --ratios--.

Signed and Sealed this

Ninth Day of May, 2000

*Attest:*

*Attesting Officer*

Q. TODD DICKINSON

*Director of Patents and Trademarks*